US010531717B2

(12) United States Patent
O'Hare

(10) Patent No.: US 10,531,717 B2
(45) Date of Patent: Jan. 14, 2020

(54) PLIABLE ASSEMBLY AND METHOD FOR RESTRAINING AND CURLING HAIR

(71) Applicant: Hilary O'Hare, Winter Haven, FL (US)

(72) Inventor: Hilary O'Hare, Winter Haven, FL (US)

( * ) Notice: Subject to any disclaimer, the term of this patent is extended or adjusted under 35 U.S.C. 154(b) by 478 days.

(21) Appl. No.: 15/433,367

(22) Filed: Feb. 15, 2017

(65) Prior Publication Data

US 2018/0084886 A1 Mar. 29, 2018

Related U.S. Application Data

(60) Provisional application No. 62/400,678, filed on Sep. 28, 2016.

(51) Int. Cl.

| | |
|---|---|
| ***A45D 2/00*** | (2006.01) |
| ***A45D 2/18*** | (2006.01) |
| ***A45D 2/12*** | (2006.01) |
| ***A45D 8/34*** | (2006.01) |
| ***A45D 2/20*** | (2006.01) |

(52) U.S. Cl.

CPC ..... *A45D 2/18* (2013.01); *A45D 2/125* (2013.01); *A45D 2/20* (2013.01); *A45D 8/34* (2013.01)

(58) Field of Classification Search

CPC . A45D 2/18; A45D 2/125; A45D 2/20; A45D 2/127; A45D 8/14; A45D 8/34; A45D 8/36

USPC ..... 132/222, 273

See application file for complete search history.

(56) References Cited

U.S. PATENT DOCUMENTS

| | | | | |
|---|---|---|---|---|
| 1,370,932 A * | 3/1921 | Tolman | A45D 2/18 | 132/245 |
| 1,540,102 A | 6/1925 | Cohen | | |
| 2,013,206 A * | 9/1935 | Haims | A45D 2/20 | 132/248 |
| 2,112,074 A * | 3/1938 | Cunnyngham | A45D 2/20 | 132/249 |
| 2,415,914 A * | 2/1947 | Silverman | A45D 2/20 | 132/247 |
| 2,422,716 A * | 6/1947 | Broyles | A45D 2/20 | 132/247 |
| 2,507,356 A * | 5/1950 | Steiner | A45D 2/18 | 132/247 |

(Continued)

*Primary Examiner* — Nicholas D Lucchesi

(74) *Attorney, Agent, or Firm* — Vincent G. LoTempio; Kloss, Stenger & LoTempio; David T. Stephenson

(57) ABSTRACT

A pliable assembly and method for restraining and curling hair serves to wrap strands of hair about an elongated panel and then fold a pair of annular members about the ends of the elongated panel to restrain and curl the hair. Further, an elastic retaining band extends between the annular members and intermeshes with the notches in the annular members, so as to securely retain the annular members in the folded arrangement around the strands of curled hair. An elongated body comprises a first end, a second end, and a central slot disposed centrally along the length of the panel. The central slot receives a strand of hair for wrapping around the panel, or an object for stowage. The annular members comprise an outer circumference defined by a junction gap and an inner circumference defined by notches. The restraint band holds annular members in folded arrangement to restrain hair.

19 Claims, 6 Drawing Sheets

(56) References Cited

U.S. PATENT DOCUMENTS

| | | | | | |
|---|---|---|---|---|---|
| 2,563,421 | A * | 8/1951 | Roth | A45D 2/20 | 132/250 |
| 2,729,217 | A * | 1/1956 | Grasso | A45D 2/127 | 132/246 |
| 2,762,379 | A * | 9/1956 | Grasso | A45D 2/18 | 132/253 |
| D300,675 | S | 4/1989 | Sacher | | |
| 5,464,030 | A * | 11/1995 | Avellanet | A45D 2/24 | 132/121 |
| 5,787,904 | A | 8/1998 | Michaud | | |
| 6,003,520 | A * | 12/1999 | Ford | A45D 2/18 | 132/247 |
| 6,076,532 | A * | 6/2000 | Thomas | A45D 8/34 | 132/273 |
| 7,013,900 | B2 * | 3/2006 | Silva | A45D 8/12 | 132/200 |
| 7,040,326 | B1 * | 5/2006 | Painter | A45D 2/143 | 132/245 |
| 7,770,586 | B2 * | 8/2010 | Tojo | A45D 2/20 | 132/222 |
| 10,560,044 | | 9/2010 | Tojo | | |
| 9,826,791 | B2 * | 11/2017 | Adkins | A42B 1/041 | |
| 2013/0213428 | A1 * | 8/2013 | Manno | A45D 8/34 | 132/210 |
| 2018/0055180 | A1 * | 3/2018 | Marcin | A45D 2/125 | |
| 2018/0199687 | A1 * | 7/2018 | Ham | A45D 8/36 | |

* cited by examiner

PLIABLE ASSEMBLY AND METHOD FOR RESTRAINING AND CURLING HAIR

CROSS REFERENCE OF RELATED APPLICATIONS

This application claims the benefits of U.S. provisional application No. 62/400,678, filed Sep. 28, 2016 and entitled HAIR HOLDER—CURLER, which provisional application is incorporated by reference herein in its entirety.

FIELD OF THE INVENTION

The present invention relates generally to a pliable assembly and method for restraining, curling, and styling the hair. More so, the present invention relates to an assembly having an elongated body and an elastic retaining band that are sufficiently pliable to fold and twist, so as to directly engage with the hair for curling the hair in a tight or loose arrangement, and curling multiple waves of hair into a single strand of hair; whereby the assembly comprises an elongated panel for imparting rotational movement to the assembly while wrapping the hair around the panel; whereby the panel comprises a first end, a second end, and a central slot disposed centrally along the length of the panel and configured to receive a strand of hair or an object; whereby a pair of annular members extend from the ends of the panel and fold in relation to the panel for retaining the hair in the curled arrangement; whereby the annular members comprise an outer circumference, an inner circumference defined by a plurality of notches, and a junction gap disposed between the annular members and the ends of the panel and configured to enable folding of the annular members relative to the panel; and an elastic retaining band configured to engage the notches, so as to securely retain the annular members in the folded arrangement around the strands of hair for restraining and curling the hair.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that hair is a protein filament that grows from follicles found in the dermis, or skin. Hair is one of the defining characteristics of mammals. The defining care of hair involves hair growth, hair types, and hair care. Hair has great social significance for human beings. The highly visible differences between male and female body and facial hair are a notable secondary sex characteristic.

Typically, a hairstyle refers to the styling of hair, usually on the human scalp. Sometimes, this could also mean an editing of beard hair. The fashioning of hair can be considered an aspect of personal grooming, fashion, and cosmetics, although practical, cultural, and popular considerations also influence some hairstyles.

Curling and straightening hair requires use of a curling rod or a flat iron to get a desired look. These irons use heat to manipulate the hair into a variety of waves, curls and reversing natural curls and temporarily straightening the hair. However, straightening or even curling hair can damage it due to direct heat from the iron and applying chemicals afterwards to keep its shape.

It is also known that many individuals with long hair prefer to have their hair off of their face when doing certain activities. However, current methods for putting the hair up have limitations and drawbacks. Elastic bands and clips often damage the hair and pull at the user's scalp. Removing them can cause hair to tangle and rip it out at the root. These items also have a tendency to slip out of the hair, which is frustrating. In addition, individuals who like curls in their hair have to spend a good deal of time with hot curling irons or hot rollers in order to obtain the desired look.

Generally, self-engaging curlers are designed to maintain hair rolled thereon in a tightly fixed roll without need for pins, clips, or elastic bands. Unfortunately, curlers of this type have the disadvantage that the number of gripping elements required for effective self-engagement also have the cumulative effect of holding the hair too tightly so that removal of the curler is often difficult and accompanied by painful tearing of the hair.

Other proposals have involved hair restraining and curling devices. The problem with these hair styling devices is that they do not provide slots for the strands of hair to pass through. Also, they do not have folding end caps that hold the curled hair in place. Also, they do not work with an elastic band to further restrain the hair in the desired curl intensity. Even though the above cited hair restraining and curling devices meet some of the needs of the market, a pliable assembly and method for restraining and curling hair that enables easy rolling of strands of hair about an elongated panel and then folding a pair of annular members about the ends of the elongated panel to restrain and curl the hair, and further, an elastic retaining band that extends between the annular members and intermeshes with the notches in the annular members, so as to securely retain the annular members in the folded arrangement around the strands of curled hair is still desired.

SUMMARY

Illustrative embodiments of the disclosure are generally directed to a pliable assembly and method for restraining, curling, and styling the hair. The assembly and method serves to enable strands of hair to be rolled about an elongated panel and then fold a pair of annular members about the ends of the elongated panel, so as to restrain the curled arrangement of hair. Further, an elastic retaining band is used to engage notches in the annular members, so as to securely retain the annular members in the folded arrangement around the strands of curled hair. The components are sufficiently pliable to fold and twist upon each other for optimal restraint and curling of the hair.

In some embodiments, the assembly may include an elongated body that works in conjunction with an elastic retaining band to engage directly with the hair for curling the hair in a tight or loose arrangement, and curling multiple waves of hair into a single strand of hair. The assembly comprises an elongated panel for imparting rotational movement so as to roll the hair around the longitudinal axis of the panel. The panel comprises a first end, a second end, and a central slot disposed centrally along the length of the panel. The central slot is sized and dimensioned to receive a strand of hair, and then roll the hair around the panel. The central slot is also effective for attaching an object for stowage, such as a key chain or ornamental member.

The assembly further comprises a pair of annular members that extend from opposite ends of the panel. The annular members are configured to fold at least 90° in two directions, relative to the panel, so as to help retain the hair in the curled or rolled arrangement around the panel. The annular members comprise an outer circumference and an inner circumference defined by a plurality of notches. The notches intermesh with the hair to aid in rolling the hair about the elongated panel.

Further, the outer circumference of the annular members are defined by a junction gap. The junction gap is disposed approximately between the annular members and the ends of the panel. The junction gap creates a weak region at the junction between the annular members and the ends of the panel, so as to enable folding of the annular members relative to the panel. This folded configuration helps the panel to retain the hair in the curled arrangement.

The assembly further comprises an elastic retaining band that works in conjunction with the panel and the annular members. The retaining band is configured to extend between the pair of annular members and engage the notches, so as to securely retain the annular members in the folded arrangement around the strands of hair. This creates a more secure arrangement for restraining and curling the hair.

In one aspect, a pliable assembly for restraining, curling, and styling the hair, comprises:

an elongated panel comprising a first end, a second end, and a central slot disposed along the length of the panel;

a pair of annular members extending from the ends of the panel, the pair of annular members configured to fold in relation to the panel, the pair annular members comprising an outer circumference defined by a junction gap and an inner circumference defined by a plurality of notches, the junction gap disposed approximately between the outer circumference of the pair of annular members and the ends of the panel, the junction gap configured to enable folding of the pair of annular members; and an elastic retaining band disposed to extend between the pair of annular members, the elastic retaining band configured to intermesh with the plurality of notches, whereby the elastic retaining band helps retain the pair of annular members in the folded configuration.

In another aspect, the elongated panel and the pair of annular members are fabricated from a flexible plastic.

In another aspect, the panel is generally flat.

In another aspect, the central slot is disposed generally in the middle of the panel.

In yet another aspect, the central slot is configured to receive a strand of hair.

In another aspect, the pair of annular members have a generally circular shape.

In yet another aspect, the junction gap follows a generally curved path.

In yet another aspect, the pair of annular members are configured to fold at least ninety degrees in relation to the panel.

In yet another aspect, the pair of annular members are configured to fold in two directions in relation to the panel.

In yet another aspect, the plurality of notches are disposed in a spaced-apart relationship.

In yet another aspect, the plurality of notches comprises three notches for each annular member.

In yet another aspect, the elastic retaining band has a generally loop-shape.

In yet another aspect, the elastic retaining band is coated with rubber.

In yet another aspect, the elastic retaining band is a rubber band.

One objective of the present invention is to provide a new and improved hair restraining and curling assembly which may be easily and efficiently manufactured and marketed.

Another objective is to roll the hair about a flat panel to achieve a curled arrangement.

Another objective is to fold the annular members about the panel to retain the hair on the panel and maintain a curled arrangement of hair.

Another objective is to extend the retaining band between the annular members and intermesh the retaining band with the notches to fasten the assembly to the hair.

Another objective is to pass a strand of hair through the central slot for rolling inot a curled arrangement.

Another objective is to provide a new and improved hair curling and styling assembly which is of durable and reliable construction.

Another objective is to provide a hair curling and styling assembly which is susceptible of a low cost of manufacture with regard to both materials and labor, and which accordingly is then susceptible of low prices of sale to the consuming public, thereby making such a hair curling device economically available to the buying public.

Another objective is to enabling the curling and styling to be performed by an unskilled person with a minimum of effort and in a minimum amount of time.

Another objective is to provide a new and improved hair curling and styling assembly for curling multiple waves of hair into a single strand of hair.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 3A shows the hair passing through the central slot, and FIG. 3B shows the hair wrapped around the panel to form a curled configuration, in accordance with an embodiment of the present invention;

Like reference numerals refer to like parts throughout the various views of the drawings.

DETAILED DESCRIPTION OF THE INVENTION

Figure 1:
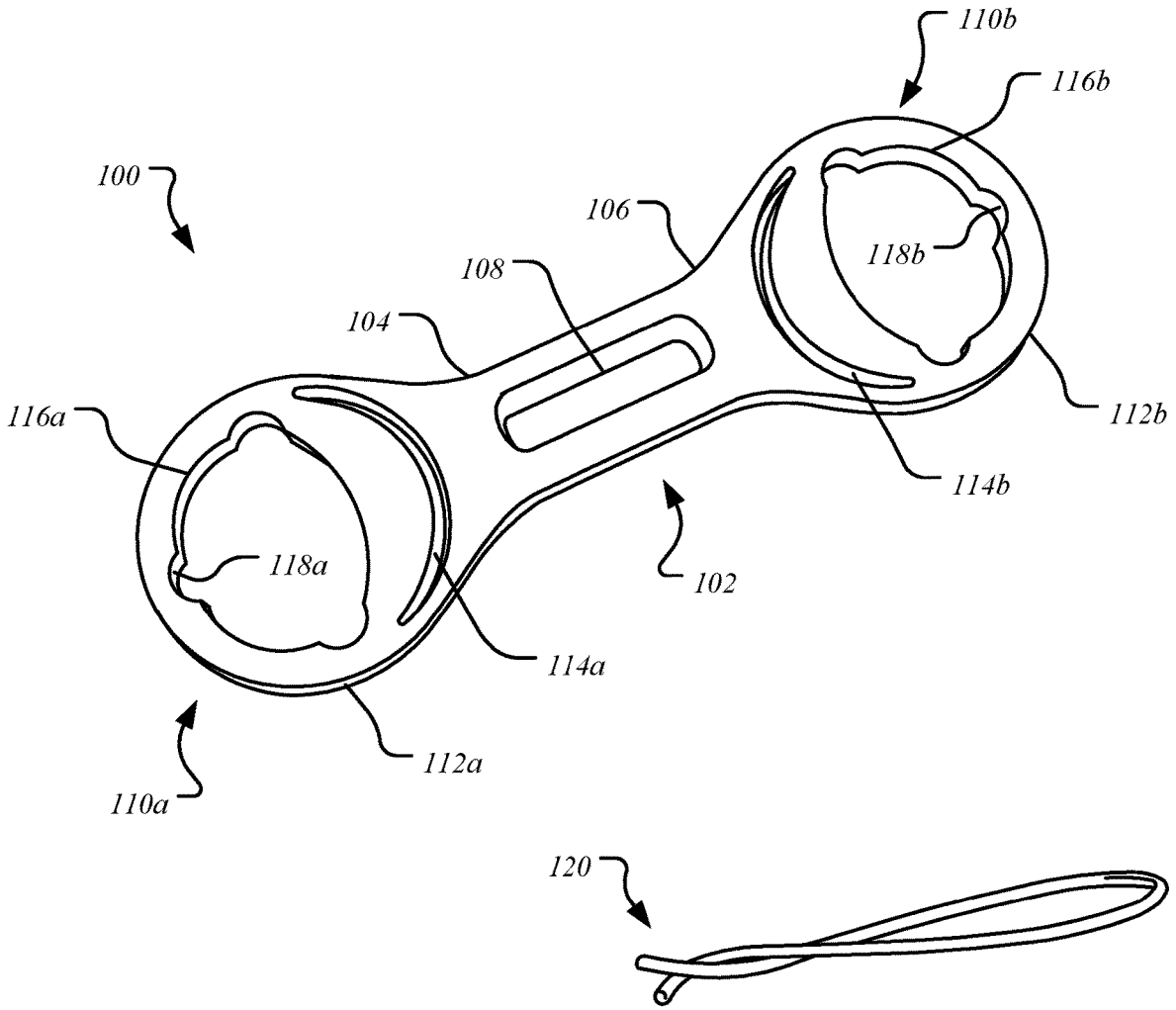
FIG. 1 illustrates a perspective view of an exemplary pliable assembly and method for restraining, curling, and styling the hair, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A pliable assembly 100 and method 300 for restraining, curling, and styling the hair is referenced in FIGS. 1-6. Assembly 100 and method 300 serves to enable strands of hair 200 to be rolled or wrapped around an elongated panel 102, and then folding a pair of annular members 110*a*, 110*b* about the ends of the panel 102, so as to restrain the panel 102 and the hair 200 in the curled arrangement. Further, an elastic retaining band 120 extends between annular members 110*a*, 110*b* and intermeshes with a plurality of notches 118*a*, 118*b* in annular members 110*a*, 110*b*, so as to help retain panel 102 and annular members 110*a*, 110*b* in a tight, curled arrangement with the strands of curled hair 200. Both panel 102 and annular members 110*a*, 110*b* are sufficiently pliable to fold and twist upon each other for easy adjustability and optimal restraint and curling of hair 200.

As illustrated in FIG. 1, assembly 100 provides an elongated panel 102. Panel 102 comprises a first end 104, a second end 106, and a central slot 108 disposed centrally along the length of the panel 102, and extending between the ends 104, 106. In one embodiment, panel 102 is flat and resilient. In some embodiments, panel 102 may be fabricated from a flexible plastic. In one embodiment, panel 102 has a length between 1.5" and 2"; a width between 0.5" and 0.9"; and a height between 0.2" and 0.4". In an alternative embodiment, panel 102 has fillets blending from top to bottom and blend smooth to the disks 0.3-0.7" Rad approximately.

In some embodiments, panel 102 works in conjunction with an elastic retaining band 120 to engage directly with the hair 200 for curling the hair 200 in a tight or loose arrangement, and curling multiple waves of hair into a single strand of hair 200. Panel 102 enables a user to impart rotational movement directly on the hair 200, so as to wrap the hair 200 around the longitudinal axis of the panel 102.

Figure 2:
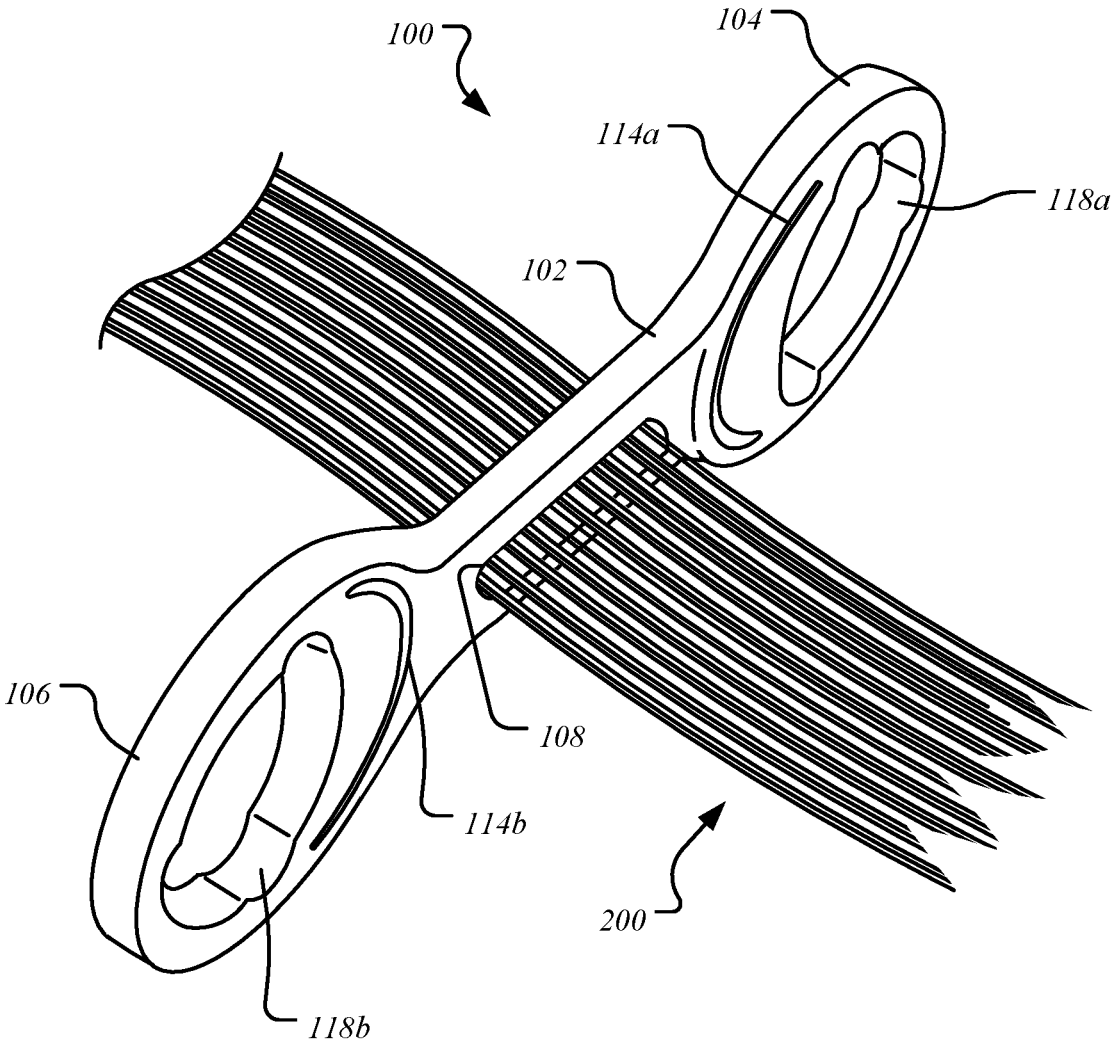
FIG. 2 illustrates a perspective view of an exemplary strand of hair passing through a central slot in an elongated panel of the assembly, in accordance with an embodiment of the present invention.

Turning now to FIG. 2, central slot 108 is disposed generally in the middle of panel 102. Central slot 108 is sized and dimensioned to receive a strand of hair 200 for wrapping around panel 102, as illustrated. Though in other embodiments, central slot 108 is sized and dimensioned to enable passage of an object for stowage, such as a key chain or ornamental member. In this manner, panel 102 serves multiple functions: retaining hair 200, and enabling items to be held in the hair 200 in a stylistic manner. In an alternative embodiment, the central slot 108 can also be used to secure a towel around the waist; or used to hold anything like string or fabrics to be spooled that fits.

In one alternative embodiment, at least one lateral slot may extend along the lateral sides of the elongated panel 102, extending between the ends 104, 106 thereof. This may be accomplished by passing the towel or object through the central slot 108, and wrapping around the panel 102.

Assembly 100 further comprises a pair of annular members 110*a*, 110*b* that extend from opposite ends of panel 102. In some embodiments, annular members 110*a*, 110*b* may comprise a pair of disc-shaped, flexible plastic components that integrally form with ends of panel 102. In one embodiment, annular members 110*a*, 110*b* have a diameter between 1.5" and 2"; and also a thickness between 0.15" and 0.30". In one embodiment, the smallest version of annular members 110*a*, 110*b* is @4.25" OAL, and the largest version is @6.00" OAL.

Annular members 110*a*, 110*b* are configured to fold at least 90° in two directions, relative to panel 102, so as to help retain the hair 200 in the wrapped arrangement around panel 102. Annular members 110*a*, 110*b* comprise an outer circumference 112*a*, 112*b* and an inner circumference 116*a*, 116*b*. Inner circumference 116*a*, 116*b* is defined by a plurality of notches 118*a*, 118*b*. In one embodiment, each annular member is defined by three spaced-apart notches 118*a*, 118*b*. As FIG. 3A references, notches 118*a*, 118*b* intermesh with the hair 200 to aid in rolling the hair 200 about the elongated panel 102.

Figure 3A:
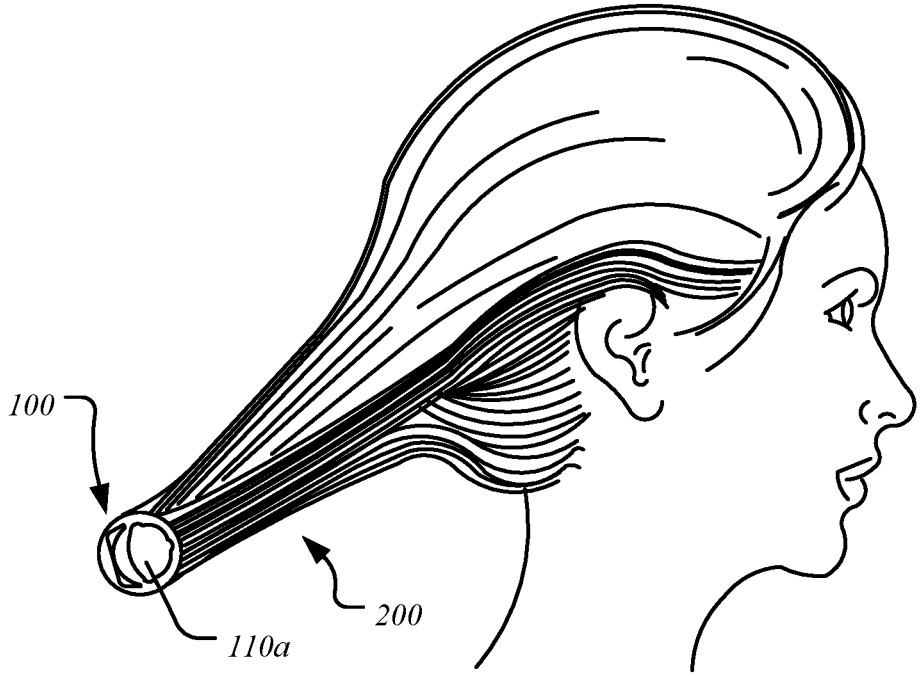
FIGS. 3A and 3B illustrates a right side view of an a pliable assembly engaging the hair, where
Figure 3B:
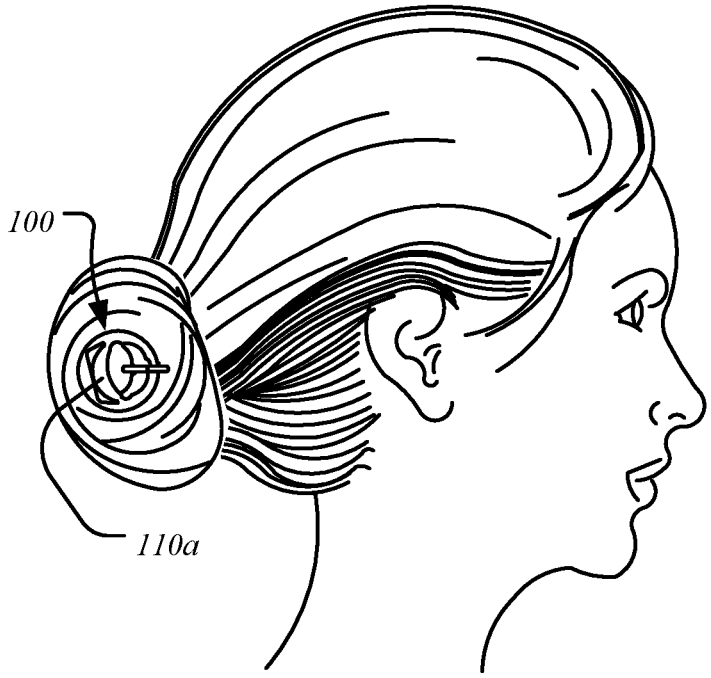

Notches 118*a*, 118*b* also provide a working surface for retaining band 120 to secure panel 102 in position, as illustrated in FIG. 3B. Specifically, notches 118*a*, 118*b* intermesh with the hair 200 to aid in rolling the hair 200 about panel 102 and also tend to maintain the hair 200 in a tight roll after assembly 100 is fixed near the scalp.

Further, the outer circumference 112*a*, 112*b* of annular members 110*a*, 110*b* are defined by a junction gap 114*a*, 114*b*. Junction gap 114*a*, 114*b* is disposed approximately between the annular members 110*a*, 110*b* and the ends of the panel 102. In one embodiment, junction gap 114*a*, 114*b* follows a generally curved path that curves along outer circumference 112*a*, 112*b* of annular member. In one embodiment, junction gap 114*a*, 114*b* is 0.15" wide.

Looking back at FIG. 1, junction gap 114*a*, 114*b* creates a weak region at the junction between the annular members 110*a*, 110*b* and the ends of the panel 102, so as to enable folding of the annular members 110*a*, 110*b* relative to the panel 102. Junction gap 114*a*, 114*b* is configured to enable folding of the pair of annular members 110*a*, 110*b* at least 90°, and in two opposing directions in relation to the panel 102. This folded configuration helps panel 102 to retain hair 200 in the curled arrangement. In an alternative embodiment, the junction gap 114*a*, 114*b* can also be used to secure a towel around the waist; or used to hold anything like string or fabrics to be spooled that fits. This may be accomplished by passing the towel or object through the junction gap 114*a*, 114*b*, and wrapping around the panel 102.

Assembly 100 further comprises a retaining band 120 works in conjunction with panel 102 and the annular members 110*a*, 110*b*. Retaining band 120 is configured to extend between the pair of annular members 110*a*, 110*b* and intermesh with the notches 118*a*, 118*b*. Retaining band 120 applies tension to the annular members 110*a*, 110*b*, holding them in the folded configuration and holding panel 102 with the wound hair 200 in place.

This retention capacity allows assembly 100 to securely retain the panel with the wound hair 200, and the annular members 110*a*, 110*b* in the folded arrangement around the strands of hair 200. Retaining band 120 can be stretched and intertwined in myriad combinations to achieve the hair fastening objective for each specific hair style. This creates a more secure arrangement for restraining and curling the hair 200. In one embodiment, retaining band 120 is resilient and coated with rubber. In another embodiment, retaining band 120 has a loop shape.

Figure 4:
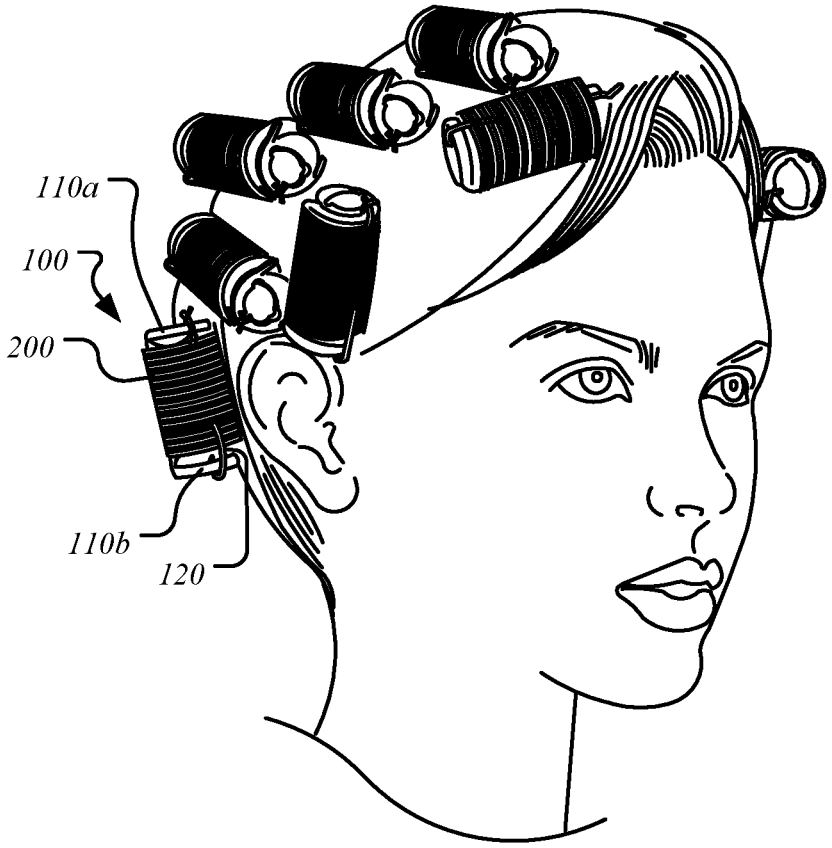
FIG. 4 illustrates a perspective view of multiple pliable assemblies engaging the hair, in accordance with an embodiment of the present invention.

As FIG. 4 illustrates multiple assemblies can be utilized throughout the entirety of the scalp to achieve the desired hairstyle. In any case, each assembly utilizes panel 102, annular members 110*a*, 110*b*, and retaining band 120 operating in substantially the same manner. For example, the entire head can be styled with multiple assemblies to create wavy hair. Any number of hairstyles may be achieved by adjusting the number of assemblies used, and the tension applied when winding the hair 200 around panel 102.

Figure 5:
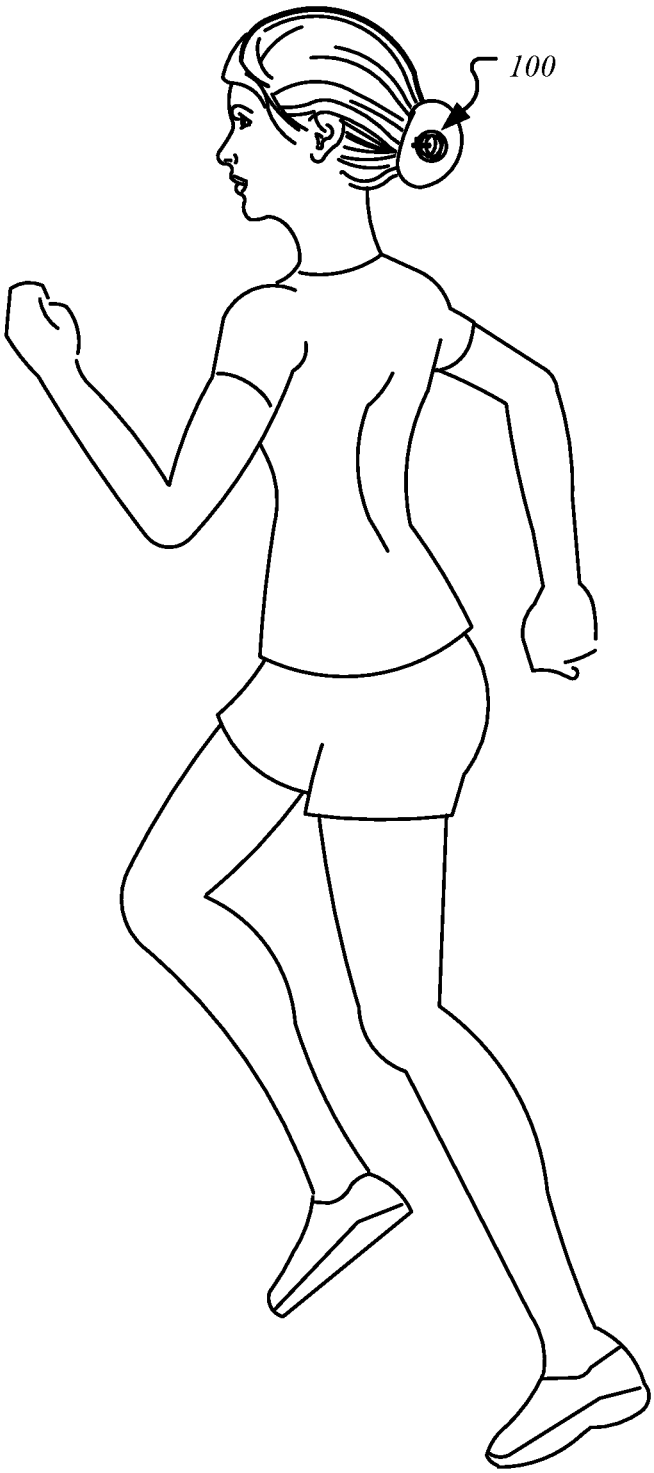
FIG. 5 illustrates a perspective view of a pliable assembly curling the hair while a user is active, in accordance with an embodiment of the present invention.

Those skilled in the art will recognize that many individuals with long hair prefer to have their hair off of their face when doing certain activities. Thus as FIG. 5 shows, a user can remain active while restraining the hair with the assembly 100. This is because assembly 100 and the wound hair 200 are firmly held in place through: 1) the rolled tension created by panel 102 winding hair 200; 2) the end fastening means on panel 102 created by annular members 110*a*, 110*b*; and 3) the tension created on the panel with retaining band 120.

In one alternative embodiment, assembly 100 may use a hook and loop fastener, such as Velcro™, or a flat narrow buckle strap, folded into a flat loop slipped into central slot 108 in place of retaining band 120. In this arrangement, annular members 110*a*, 110*b* can be coupled to the drops of a road bike or on a handle bar then place a bottle of Halt® or mace into the Velcro™ loop and wrap the Velcro™ around the handle bar or the drop tightly. In this manner, the bottle can be aimed for easy deployment when needed to ward off dangerous animals or attacks. This can also be used as a spool that prevents the spooled material from unwinding when stored.

Figure 6:
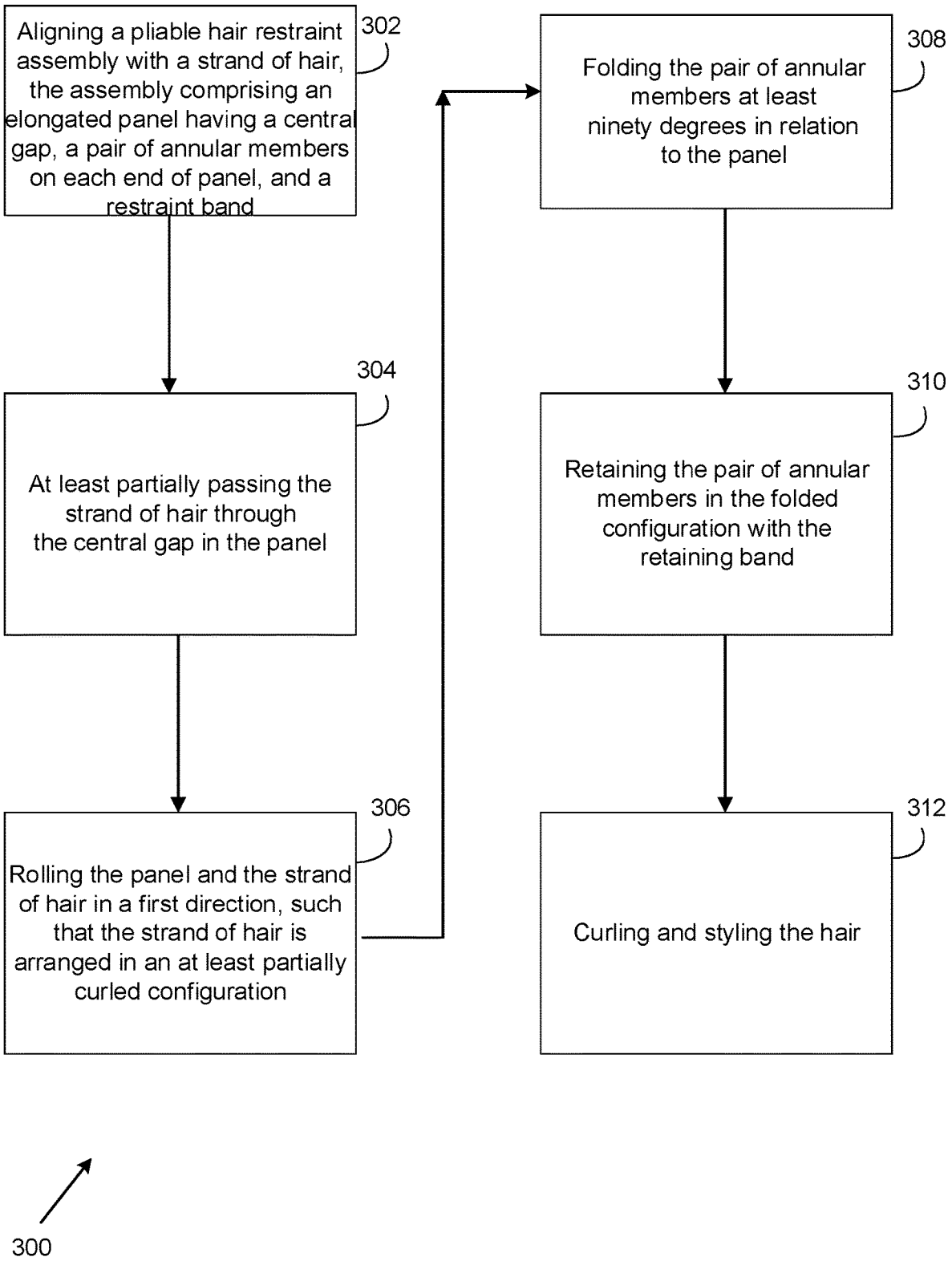
FIG. 6 illustrates a flowchart of an exemplary method for restraining, curling, and styling the hair with a pliable assembly, in accordance with an embodiment of the present invention.

FIG. 6 illustrates a flowchart of an exemplary method 300 for restraining, curling, and styling the hair 200 with a pliable assembly 100. An initial Step 302 comprises aligning a pliable hair 200 restraint assembly 100 coplanar with a strand of hair 200, the assembly 100 comprising an elongated panel 102 having a central slot 108, a pair of annular members 110*a*, 110*b* on each end of the panel 102, and a restraint band. Panel 102 enables hair 200 to be wound, so as to achieve a desired retention and curl.

A Step 304 may include at least partially passing the strand of hair 200 through the central slot 108 in the panel 102. Central slot 108 is disposed generally in the middle of panel 102. Central slot 108 is sized and dimensioned to receive a strand of hair 200 for wrapping around panel 102, as illustrated. The method 300 further includes a Step 306 of rolling the panel 102 and the strand of hair 200 in a first direction, such that the strand of hair 200 is arranged in an at least partially curled configuration.

In some embodiments, a Step 308 includes folding the pair of annular members at least 90° in relation to the panel. Junction gap 114*a*, 114*b* creates a weak region at the junction between the annular members 110*a*, 110*b* and the ends of the panel 102, so as to enable folding of the annular members 110*a*, 110*b* relative to the panel 102. Junction gap 114*a*, 114*b* is configured to enable folding of the pair of annular members 110*a*, 110*b* at least 90°, and in two opposing directions in relation to the panel 102. This folded configuration helps retain the hair 200 in the curled arrangement.

Another Step 310 comprises retaining the pair of annular members 110*a*, 110*b* in the folded configuration with the retaining band 120. Retaining band 120 works in conjunction with panel 102 and the annular members 110*a*, 110*b*. Retaining band 120 is configured to extend between the pair of annular members 110*a*, 110*b* and intermesh with the notches 118*a*, 118*b*. Retaining band 120 applies tension to the annular members 110*a*, 110*b*, holding them in the folded configuration and holding panel 102 with the wound hair 200 in place. A final Step 312 comprises curling and styling the hair 200. Any number of hairstyles may be achieved by adjusting the number of assemblies used, and the tension that is applied when winding hair 200 around panel 102.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A pliable assembly for restraining, curling, and styling the hair, the assembly comprising:

an elongated panel comprising a first end, a second end, and a central slot disposed along the length of the panel;

a pair of annular members extending from the ends of the panel, the pair of annular members configured to fold in relation to the panel, the pair of annular members each comprising an outer circumference defined by a junction gap and an inner circumference defined by a plurality of notches, the junction gap disposed approximately between the outer circumference of a respective annular member and an end of the panel, the junction gap configured to enable folding of a respective annular member; and a retaining band disposed to extend between the pair of annular members, the retaining band configured to intermesh with the plurality of notches of a respective annular member, whereby the retaining band helps retain the pair of annular members in a folded configuration.

2. The assembly of claim 1, wherein the elongated panel and the pair of annular members are fabricated from a flexible plastic.

3. The assembly of claim 1, wherein the panel is generally flat.

4. The assembly of claim 1, wherein the central slot is disposed generally in the middle of the panel.

5. The assembly of claim 1, wherein the central slot is configured to receive a strand of hair.

6. The assembly of claim 1, wherein each of the pair of annular members have a generally circular shape.

7. The assembly of claim 1, wherein the junction gap has a generally curved shape.

8. The assembly of claim 1, wherein the pair of annular members are configured to fold at least ninety degrees in relation to the panel.

9. The assembly of claim 1, wherein each of the pair of annular members are configured to fold in two directions in relation to the panel.

10. The assembly of claim 1, wherein the plurality of notches are disposed in a spaced-apart relationship.

11. The assembly of claim 1, wherein the plurality of notches comprises three notches for each annular member.

12. The assembly of claim 1, wherein the retaining band has a generally loop-shape.

13. The assembly of claim 1, wherein the retaining band is coated with rubber.

14. The assembly of claim 1, wherein the retaining band is a resilient rubber band.

15. A pliable assembly for restraining, curling, and styling the hair, the assembly comprising:

an elongated panel comprising a first end, a second end, and a central slot disposed along the length of the panel; and a pair of annular members extending from the ends of the panel, the pair of annular members configured to fold in relation to the panel, the pair annular members each comprising an outer circumference defined by a junction gap and an inner circumference defined by a plurality of notches, the junction gap disposed approximately between the outer circumference of a respective annular member and an end of the panel, the junction gap configured to enable folding of the pair of annular members.

16. The assembly of claim 15, further comprising a retaining band disposed to extend between the pair of annular members.

17. The assembly of claim 16, wherein the retaining band is configured to intermesh with the plurality of notches of a respective annular member.

18. The assembly of claim 17, wherein the retaining band helps retain the pair of annular members in the folded configuration.

19. The assembly of claim 15, wherein the pair of annular members are configured to fold at least ninety degrees in relation to the panel.

* * * * *